United States Patent [19]

Brunner

[11] Patent Number: 4,941,321

[45] Date of Patent: Jul. 17, 1990

[54] DIRECTIONAL CONTROL WITH LOAD-SENSING PASSAGE CONTROLLED BY THROTTLING NON-RETURN VALVE HAVING ADJUSTABLE BIASING SPRING

[75] Inventor: Rudolf Brunner, Baldham b. Munich, Fed. Rep. of Germany

[73] Assignee: Heilmeier & Weinlein Fabrik Fur Oelhydraulik GmbH & Co.K, Fed. Rep. of Germany

[21] Appl. No.: 320,076

[22] Filed: Mar. 6, 1989

[30] Foreign Application Priority Data

Mar. 8, 1988 [DE] Fed. Rep. of Germany ..... 3807583

[51] Int. Cl.[5] ..... F15B 13/02

[52] U.S. Cl. ..... 60/468; 91/518; 137/596.13

[58] Field of Search ..... 60/420, 427, 450, 452, 60/445, 459, 464, 468; 91/518, 530; 137/596.13

[56] References Cited

U.S. PATENT DOCUMENTS

| | | | |
|---|---|---|---|
| 3,971,216 | 7/1976 | Miller | 60/445 |
| 4,325,410 | 4/1982 | Bernhardt et al. | 137/596.13 |
| 4,436,020 | 3/1984 | Budzich | 137/596.13 X |
| 4,610,271 | 9/1986 | Balmer et al. | 137/596.13 |
| 4,879,945 | 11/1989 | Brunner et al. | 60/468 X |

*Primary Examiner*—Edward K. Look
*Assistant Examiner*—George Kapsalas
*Attorney, Agent, or Firm*—Kinzer, Plyer, Dorn, McEachran & Jambor

[57] ABSTRACT

A directional control valve between the pump and consumer has a load-pressure-sensing connection with a variable throttle. The sensed load pressure acts to bias a supply-flow-bypassing pressure compensation valve connected to the main pump line. Control of the load pressure throttling allows the increase in main pump line pressure to be adapted continuously and automatically to the demand. The variable throttle includes a spring-biased nonreturn valve in which the spring bias varies in proportion to the lift movement and in an infinitely variable manner at least over a portion of the lift path of the valve spool.

8 Claims, 3 Drawing Sheets

DIRECTIONAL CONTROL WITH LOAD-SENSING PASSAGE CONTROLLED BY THROTTLING NON-RETURN VALVE HAVING ADJUSTABLE BIASING SPRING

BACKGROUND OF THE INVENTION

This invention relates to a hydraulic control apparatus.

In such a control apparatus known from U.S. Pat. No. 39 71 216 the flow resistance of the nonreturn valve effects an increase in pressure by means of which the pressure compensation valve continuously keeps the pressure in the pump line above the consumer pressure. Since a spring actuation of the closing member of the nonreturn valve remains constant over the whole operational range, the pressure difference between the pressure in the pump line and the pressure in the consumer line remains also constant over the whole operational range. The pressure difference must be designed for the maximum capacity of the consumer so that the maximum power is achieved in the control-position end position of the directional control valve. In intermediate positions of the directional control valve this pressure difference is therefore greater than necessary, resulting in a waste of power which, for instance, causes an increased mechanical load on the pressure medium and the heating thereof.

In German Offenlegungsschrift 37 22 083 which is of a prior date a hydraulic control apparatus is suggested wherein the pressure for the spring side of the pressure compensation valve is increased step by step so as to be able to make use of the maximum power when or shortly before the control-position end position of the directional control valve is reached, and, prior thereto, of only a portion thereof. An infinitely variable increase in the pressure difference for adaptation to the demand of the consumer is not possible.

SUMMARY OF THE INVENTION

This invention is based on improving a hydraulic control apparatus of the type mentioned at the outset in such a way that the pressure difference between the pump line and the consumer line is precisely adapted to the respective demand of the consumer.

Under the present construction the pressure is increased at least over a portion of the lift of the control member of the directional control valve in response to the infinitely variable bias of the spring of the return valve. This means that while the control member is approaching the control-position end position and the bias of the spring is being increased, the flow resistance through the nonreturn valve progressively increases. When there is a small lift from the neutral position, the pressure difference between the pump line and the consumer line is just sufficiently great that the amount adjusted with the aid of the directional control valve can be achieved in the consumer line without any difficulties. The pressure difference increases with an increasing lift from the neutral position so that when or shortly before the control-position end position is reached, a maximum pressure difference and thus the maximum amount for the consumer are obtained. In each intermediate position of the control member of the directional control valve the pressure difference is just so great that the consumer is acted upon to the desired degree. An optimum utilization of the power, a precise adaptaton to the power and a decreased mechanical load on the pressure medium over the operational range of the directional control valve follow therefrom. As a result of the reduced increase in pressure in the intermediate position of the comtrol member of the directional control valve, the loss of power during outflow via the pressure compensation valve is smaller. Since adaptation to the power is carried out in an infinitely variable manner, pressure impacts are suppressed in the control system. The pressure course in the pump line forms a relatively uniform curve which only gradually rises relative to the pressure course in the consumer line. The control characteristic, too, i.e. the amount of pressure medium of the consumer over the lift of the control member of the directional control valve, is a harmonic curve wich at least over the portion of the increasing bias of the spring of the nonreturn valve extends with an almost constant rise. The closing member of the nonreturn valve in first hardly loaded or not at all loaded by the spring to avoid unnecessary losses at the beginning of the fine control range of the directional control valve. Before the bias is started, the spring may even permit a lost motion of the closing member. The nonreturn function in ensured through the flow dynamics.

One embodiment is of a simple construction. A mechanical adjustment device does not impair the functioning of the directional control valve, it is reliable from an operational point of view and can be easily constructed without any fundamental modifications of the directional control valve.

Another important idea is that when the non-return valve is arranged in the interior of the control member of the directional control valve, the adjustment movement for biasing the spring of the nonreturn valve can be directly sensed in an especially advantageous way.

In a preferred embodiment, which is simple from a constructional point of view, the control member automatically biases the spring of the nonreturn valve. Since the components which are of importance to the presence increase are accommodated in the control member, the dimensions of the directional control valve are not enlarged. The interior of the control member which is usually not required for any other functions can be advantageously used for the forced control of the pressure increase. The counterpressure resulting from the bias on the control member is negligible.

Furthermore, in a preferred embodiment the coupling member adjusts the spring of the nonreturn valve in a directly proportional manner with respect to the lift of the control member. A small diameter of the rod ensures small counterforces from the consumer pressure.

A further feature of the invention is that the adaptation is expedient insofar as the adaptation to capacity which precisely depends on the consumer is only needed over the fine control range of the directional control valve. This measure has also the advantage that the spring must only be deformed over a portion of the entire lift path of the control member and can thus operate in a relatively linear area of its spring characteristic even if it does not have a great overall length. The point from which the spring is biased can be exactly determined by the distance.

According to another embodiment the initial point of the bias of the spring can be adjusted from outwards so as to be also able to adjust the spring more strongly or more weakly during the deformation depending on the lift of the control member.

Finally, the inventive embodiment is also expedient because an adaptation to the respective lift of the control member of a directional control valve is also possible by varying the effective length of the coupling member.

The spring of the nonreturn valve may consist of two springs which are fitted into each other and of which the weaker one only ensures the closing position in the pressureless state while the other one does only become operative after a major lift of the closing member - and then more strongly. For instance, biasing of the closing member is only started when the control member is adjusted such that there is a flow rate of about 50/min towards the consumer.

BRIEF DESCRIPTION OF THE DRAWINGS

Embodiments of the subject matter of the invention will be explained on the basis of the drawings wherein.

DETAILED DESCRIPTION OF THE PREFFERED EMBODIMENTS

Figure 1:
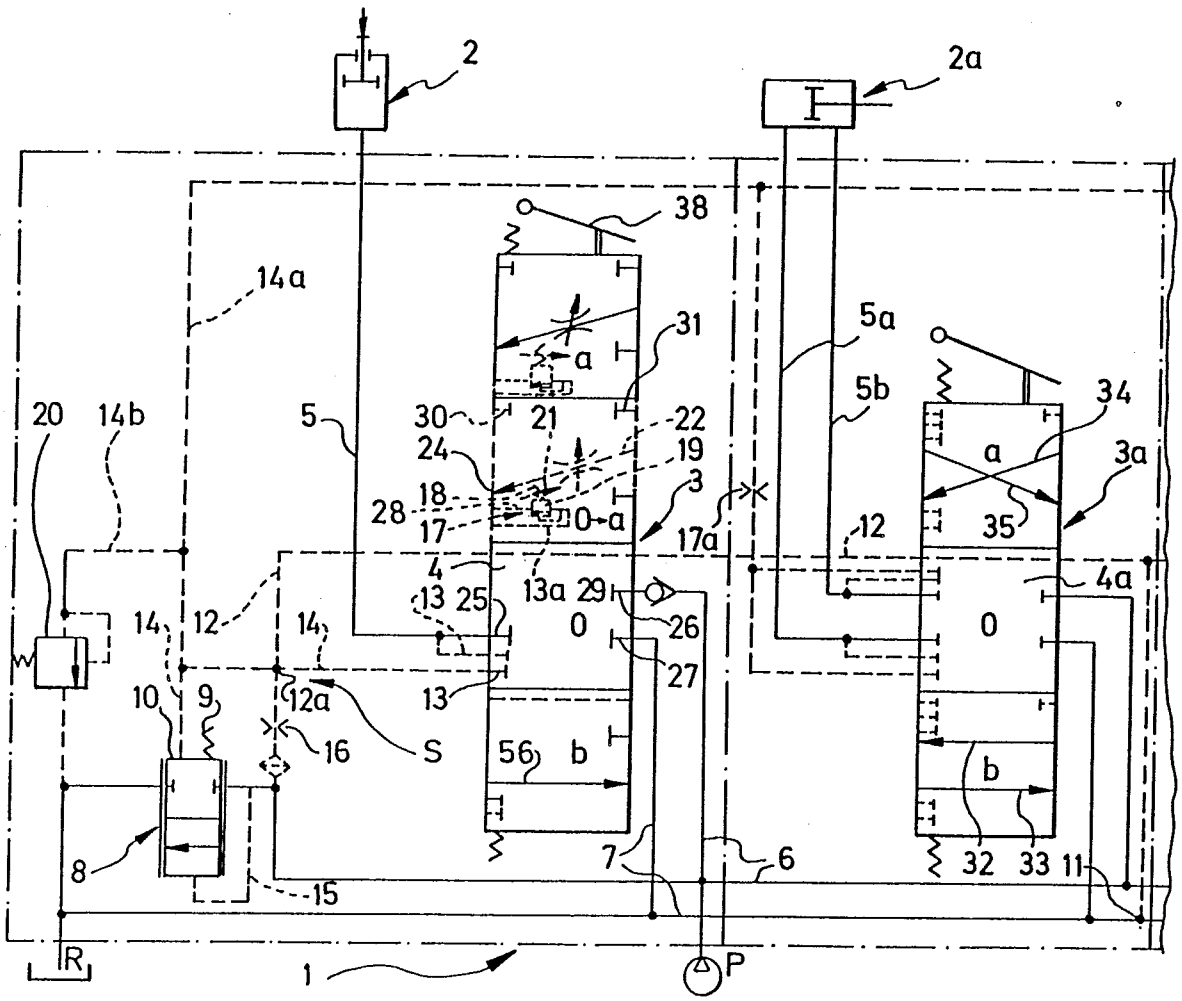
FIG. 1 shows a circuit diagram of a hydraulic control apparatus.

A hydraulic control apparatus 1 according to FIG. 1 which is for instance intended for a stacker truck or a fork-lift truck having a plurality of hydraulic consumers, such as a lifting cylinder 2 adapted to be acted upon at one side and a tilting cylinder 2*a* adapted to be acted upon at two sides, includes directional control valves the number of which corresponds to that of the consumers, in the present case two directional control valves 3 and 3*a*. The two directional control valves 3 and 3*a* are connected parallel to a pump line 6 fed by a pressure source P, e.g. a fixed displacement pump. The directional control valves 3, 3*a* are connected to a common return line 7 leading to a tank R. A pressure compensation valve 8 of a usual construction is provided between the pump line 6 and the return line 7, said pressure compensation valve including a slide 10 which is adjustable in an infinitely variable way between a shut-off position (FIG. 1) and a passage position and which can establish a direct, more or less throttled connection to the return line 7. The slide 10 is biased by a spring 9 towards its shut-off position.

A connected control line circuit S is fed with pressure medium from the pump line 6. A first control line 12 is branched off from the pump line 6 and leads via both directional control valves 3, 3*a* to a relief connection 11 of the return line 7. A control member 4, 4*a* which includes a flow duct 29 which establishes the passage from the first control line 12 to the relief connecton 11 in the neutral position (FIG. 1) is adjustable in each directional control valve 3, 3*a*. A second control line 14 first leads from the spring side of the pressure compensation valve 8 to a connection point 12*a* with the first control line 12 and further to a load-pressure sensing connection 13 of the directional control valve 3. A control branch 14*a* for the load-pressure sensing connection of the directional control valve 3*a* is led to the second control line 14. Furthermore a control line branch 14*b* leads via a pressure relief valve 20 for the system pressure from the control line branch 14*a* to the return line 7. A third control line 15 leads from the pump line 6 to the other side of the slide 10 of the pressure compensation valve 8.

A first throttle point 16 is provided in the first control line 12 upstream of the connection point 12*a*. The input pressure thereof is transmitted via the third control line 15 to the side of the slide 10 opposite the spring side in the pressure compensation valve 8. A second throttle point 17 for the second control line 14 is provided, for instance in the control member 4, in the directional control valve 3. The input pressure thereof is transmitted in the second control line 14 to the spring side of the slide 10 of the pressure compensation valve 8. The flow resistance of the first throttle point 16 is smaller than the flow resistance of the second throttle point 17.

In both directional control valves 3, 3*a* the control member 4, 4*a* is adjustable in an infinitely variable way from the neutral position 0 into two control positions a and b, an intermediate position 0/a of the control member 4 between the neutral position 0 and the control-position end position a in which the control member 4 has carried out even less than for example 80% of the lift towards the control-position end position being indicated in FIG. 1 in broken line in the case of the directional control valve 3.

The directional control valve 3 has a connection 25 which has connected thereto a consumer line 5 to the lifting cylinder 2 from which a flow path which is indicated in broken line and in which the pressure of the consumer line 5 is present is branched off. A flow connection can be established in the control member 4 between the load-pressure sensing connection 13 and the flow path 23 as soon as the control member 4 is adjusted towards the control position a. For this purpose, a duct 13*a* is connected in the control member 4 to a duct 28 via the second throttle point 17, the duct 13*a* being adapted to be connected to the load-pressure sensing connection 13, and the duct 28 being connectable to the consumer line 5 via a flow connection 24 and the flow path 23, respectively. The second throttle point 17 is a non-return valve 19 including a spring 18, a mechanical adjustment device 21 (see FIG. 2, 3) being provided for biasing the spring 18.

A main flow path 22 which in the control position a connects a connection 26 of the pump line 6 to the connection 25 of the consumer line 5 is formed in the control member 4. In the control position b a main flow path 56 connects the connection 25 to a connection 27 of the return line 7. Connections 30. 31 which are adapted to be shut off serve to shut off the flow path for the control line 12 during lift into the control position a.

The second directional control valve 3*a* for the tilting cylinder 2*a* is connected thereto via consumer lines 5*a* and 5*b*. Its control member 4*a* contains main flow paths 32, 33 and 34, 35 for controlling the alternate actuation of both sides of the tilting cylinder. Another second throttle point 17*a* is included in the control line branch 14*a*. The input thereof is present at the spring side of the slide 10 of the pressure compensation valve 8 whenever the second directional control valve 3*a* is operated. A nonreturn valve is provided at the throttle point 17*a*, if necessary.

The control members 4, 4*a* of the directional control valves 3, 3*a* are adjustable by means of actuating elements 38. The adjustment of the control members through pressure actuation at the ends is also possible.

In a block-shaped housing 36 the directional control valve 3 (FIG. 2, 3) has a longitudinally exttending bore 37 for the control member 4 designed as a slide piston. The actuation 38 (arrow) acts on the upper end of the control member 4. At the lower end the bore 37 is closed by an end wall 39 which cooperates with the adjustment device 21 for the spring 18 of the nonreturn valve 19.

The nonreturn valve 19 is disposed in the interior of the control member 4, namely in a chamber 40 in which at the upper end a seat 41 is provided for a ball-shaped closing member 42 of the nonreturn valve 19. At the bottom a spring seat 43 provided on the upper end 18*a* of the spring 18 is opposite the closing member 42. The lower end 18*b* of the spring 18 is seated on a spring seat 48 which is liftably supported on an insert 44 screwed into the chamber 40 from below. The spring 18 is retained between the spring seats 48 and 43 with a very small bias, if at all. The closing member 42 may even carry out a small lost motion, if necessary. The spring seat 48 has retained therein a coupling member 45, e.g. a longitudinally displaceable rod, which projects with its free end 46 towards the end wall 39. In the neutral position of the control member 4 there is a distance x between the free end 46 and the end wall 39 which forms an abutment for the free end 46. The diameter of the rod is about 1 mm.

The duct 13*a* outlined in FIG. 1 starts at the outer circumference of the control member 4 in a longitudinally extending flow pocket 47 and leads to the side of the seat 41 facing away from the closing member 42. The duct 28 leads from the chamber 40 to the outer circumference of the control member 4. The second control line 14 which leads to the pressure-load sensing connection 13 in the wall of the bore 37 can be seen in the housing 36. A neck in the bore 37 constitutes the connection 25 to the consumer line 5 and forms the flow path andd flow duct 23, 24 putlines in FIG. 1 during lift towards the control position a. In the outlined neutral position of the control member 4 the load-pressure sensing connection 13 is connected to the duct 13*a*. By contrast, the bore wall covers the opening of the duct 28 which is thus separated from the connection 25. According to FIG. 2 the control member 4 is equipped with two diametrically opposite, longitudinally extending big flow pockets which in the neutral position a form the main flow path 22 outlined in FIG. 1 and are connected by (FIG. 3) a bore 49. The flow pockets are in front of the connection 26 to the pressure source P. The circumference of the control member 4 separates the connection 25 from the connection 26.

When the control member 4 is adjusted downwards (control position a), the flow pockets (flow path 22) cooperate with the connection 25 like adjustable orifices to establish a more or less throttled connection from the pump line 6 to the consumer line 5.

When the control member 4 is displaced from the neutral position upwards, the outer circumference of the control member 4 separates the connection 25 from the connection 26 while the lower end (flow path 56) of the control member 4 releases the connection 25 to the connection 27 in the lower end of the bore 37 so that the pressure medium flows out form the lifting cylinder 2.

The load-pressure connection 13 is located in the circumferential area of the bore wall along which the flow pocket 47 positioned between the big flow pockets and separated therefrom is moved during the adjustment of the control member 4. The control member 4 is secured against rotation. The connection between the second control line 14 and the duct 13*a* is open between the neutral position and the control position a. In the neutral position (FIG. 3) the opening of the duct 28 on the circumference of the control member 4 is spaced from and above the neck forming the connection 25, with said spacing approximately corresponding to the distance x. The bottom ends (FIG. 2) of the big flow pockets have formed thereon inclined surfaces 57 which, the circumferential direction being displaced, enter into the circumference of the control member 4 at about the same axial height as the opening of the duct 28. As soon as the surfaces 57 start to enter into the neck forming the connecton 25, adjustable orifices are formed through which the pressure medium flows from the connection 26 to the consumer line. At the same moment, or even with a slight advance, the opening of the duct 28 also enters into the neck. The pressure prevailing in the connection 25 is thereby always transmitted into the chamber 40 where it presses the closing member 42 against the seat 41.

Figure 2:
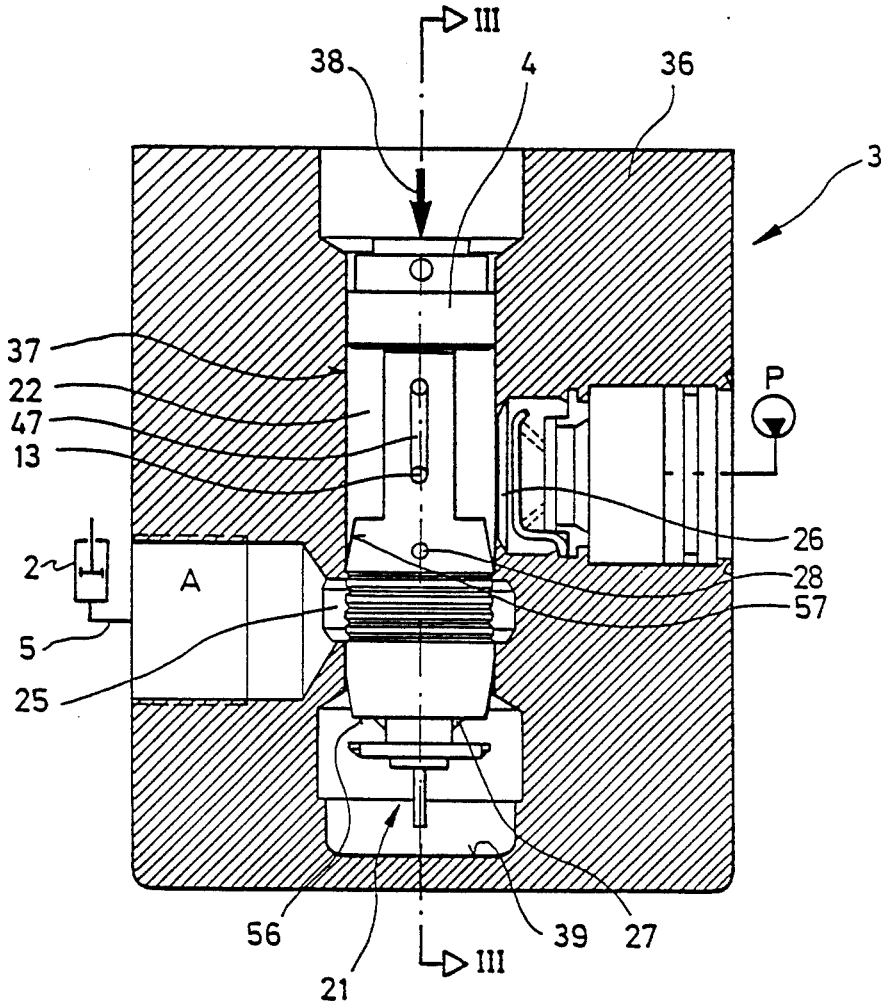
FIG. 2 shows a longitudinal section through a directional control valve of the control apparatus of FIG. 1.
Figure 3:
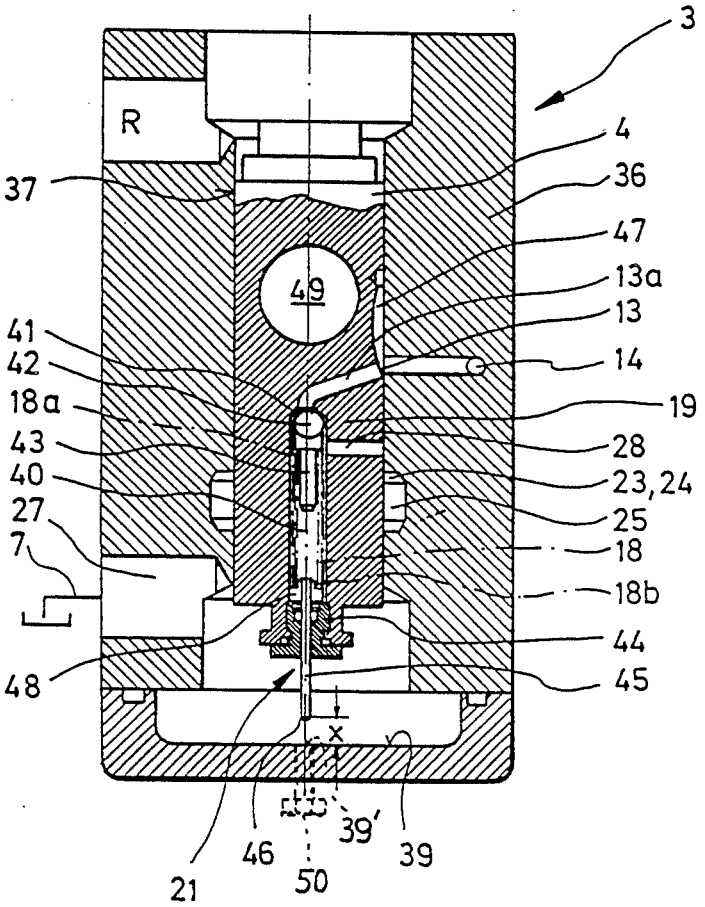
FIG. 3 shows a sectional view of the directional control valve of FIG. 2 turned by 90° with respect to FIG. 2.

According to FIG. 1 through 3 the flow duct 29 in the control member 4 is shut off beforehand so that the first control line 12 is no longer connected to the relief connection 11. On the assumption that the second directional control valve 3*a* is not operated, the slide 10 of the pressure compensation valve 8 is adjusted until it gradually performs a throttling action. The pressure in the control line circuit S also increases with an increasing pressure in the pump line 6. The pressure in the second control line 14 is present at the closing member 42 via the duct 13*a*. Pressure medium flows past the closing member 42 to the consumer line 5 so that the pressure in the second control line 14 is adjusted to a value which approximately corresponds to that of the consumer pressure. As soon as the free end 46 of the coupling member 45 abuts on the end wall 39 during the further displacement of the control member 4 towards the control-position end position, the spring seat 48 is lifted from the insert 44. The spring 18 is biased according to the lift movement of the control member 4. A closing force is thereby created in the nonreturn valve 19, and the flow resistance for the pressure medium in the second control line 14 increases. The pressure in the second control line 14 increases, with the result that the pressure compensation valve 8 has a stronger throttling effect, whereby the pressure in the pump line 6 further increases. Until the control-position end position is reached, the pressure in the second control line is thereby increased and, in response thereto, the pressure in the pump line 6, i.e. not only in dependence upon the rising load pressure in the consumer line 5, but, in addition, by the progressive bias of the spring 18. It is expedient when the increase in bias of the spring 18 is mainly operative in the so-called fine control range of the control member 4, i.e. between the lift position in which the surfaces 57 just starts to enter into the neck forming the connection 25, e.g. from 50 l/min onwards, and the lift position in which the big flow pockets of the flow path 22 are free towards the connection 25 in a substantially unrestricted way. The pressure difference between the pressure in the pump line 6 and the pressure in the consumer line 5 continuously increases in a corresponding manner. When the control member 4 is returned into the neutral position, the bias of the spring 18 decreases again in accordance with the lift path.

When the control member 4 is displaced in the opposite direction, the flow path 56 connects the connection 25 to the connection 27 so that the pressure medium can flow off. The nonreturn valve 19 is then without any function and closed.

When the second directional control valve 3a is moved from its neutral position, the pressure in the pump line 6 is increased by the action of the second throttle point 17a for the whole operational area of the directional control valve 3a, and the difference with respect to the pressure in one of the consumer lines 5a and 5b remains constant. When the two directional control valves 3, 3a are simultaneously operated, the pressure is increased in response to the respectively lower input pressure of one of the two throttle points 17 and 17a. If this is to be avoided, means (not shown) are provided for giving the directional control valve 3 priority over the directional control valve 3a.

The nonreturn valve 19 whose spring bias is variable in response to the lift of the control member 4 may also be arranged outside the directional control valve or in the housing of the directional control valve in the second control line 14. Furthermore, it is readily possible to equip each of the directional control valves of the control apparatus 1 for each actuation direction with such a nonreturn valve having a biased spring so that the increase in pressure which is exactly adapted to the demand and intended for each consumer and even for each working direction is then effective to a different degree, if necessary. Furthermore, the control circuit may have provided therein alternating valves which ensure that the consumer and the consumer working direction are respectively given priority over the other ones that just require the greatest amount of pressure medium.

Instead of the mechanical adjustment device 21 for the spring 18, a hydraulic or electric adjustment device could also be provided. For instance, when there is a hydraulic adjustment device, the consumer pressue in the connection 25 can be applied to a piston on which the spring 18 is supported and which biases the spring 18 when the consumer pressure increases. In this case, too, the bias would strictly depend on the lift of the control member because with an increasing lift of the control member towards the control-position end position the pressure in the connection 25 increases accordingly.

An adjusting screw 50 in the end wall 39 is outlined in broken line in FIG. 3, the end thereof forming the abutment 39' for the free end 45. The distance x and thus the point from which the spring 18 is biased can be varied by adjusting the screw 50.

I claim:

1. A hydraulic control apparatus (1) comprising at least one directional control valve (3, 3a) which is arranged in front of a consumer (2, 2a) and whose control member (4, 4a) shuts off at least one consumer line (5, 5a, 5b) in a neutral position (0) and alternately connects same in two control position (a, b) to a pump line (6) fed from a source of pressure (P) or to a return line (7), a pressure compensation valve (8) which is connected to said pump line and which, for the purpose of returning the pressure medium that is not required by said consumer, includes a slide (10) which is spring-loaded towards the shut-off position, a control line circuit (S) which is connected to said pump line and which includes a first control line (12) leading from said pump line to a relief connection (11) connected in said neutral position to said return line, a second control line (14) connected to said first control line (12) for connecting the spring side of said slide (10) of said pressure compensation valve (8) to at least one load-pressure sensing connection (13) of said directional control valve (3, 3a) and a third control line (15) at another side of said slide (10) of said pressure compensation valve (8), said load-pressure sensing connection (13) being connected to said consumer line in at least one control position (a), a first throttle point (16) in said first control line (12) whose input pressure acts via said third control line (15) on said slide (10) against the spring load, and a second throttle point (17, 17a) provided between said load-pressure sensing connection and the connection point (12a) of said first and second control lines, whose input pressure can be raised during adjustment of said control member (4, 4a) from said neutral position (0) and transmitted to the spring side of said slide (10), said second throttle point (17) controlling the flow from said second control line (14) through said load-pressure sensing connection (13) to said consumer line (5) and there being at least one nonreturn valve (19) which includes a spring (18) operative in the closing direction and which opens in the direction of flow towards said consumer line (5), characterized in that said spring (18) is biased in proportion to a lift movement of said control member and in an infinitely variable manner at least over a portion of the lift path of said control member (4) from said neutral position (0) into the position connecting said pump line and said consumer line.

2. A hydraulic apparatus accordng to claim 1, characterized in that a mechanical adjustment device (21) is provided for adjusting the bias of said spring (18).

3. A hydraulic control apparatus according to claim 1 characterized in that said nonreturn valve (19) is disposed in the interior of said control member (4) of said directional control valve (3).

4. A hydraulic control apparatus according to claim 3 characterized in that in said control member (4) said nonreturn valve (19) is disposed in a chamber (40) between a duct (13a) leading to said load-pressure sensing connection (13) and a duct (28) adapted to be connected to said consumer line (5), and that said spring (18) which is associated with the closing member (42) of said nonreturn valve (19) at one of its ends is adapted to be supported at its other end on an abutment (39, 39') which is stationary during the lift movement of said control member (4) relative thereto.

5. A hydraulic control apparatus accordng to claim 4, characterized in that a rigid coupling member (45), preferably a displaceably guided rod, which transmits the relative movement between said control member (4) and said abutment (39, 39') to said spring (18) is provided between said closing member (42) and said abutment (39, 39').

6. A hydraulic control apparatus to claim 5 characterized in that in said neutral position (0) of said control member (4) there is a distance (x) between the free end (46) of said coupling member (45) and said abutment (39, 39'), said distance being smaller than the lift path of said control member (4) from said neutral position (0) into said position connecting said pump line and said consumer line.

7. A hydraulic control apparatus according to claim 6, characterized in that said abutment (39') is adjustable for varyig said distance (x).

8. A hydraulic control apparatus according to claim 5, characterized in that the effective length of said coupling member (45) is adjustable.

* * * * *